US006915729B2

(12) United States Patent
Kim

(10) Patent No.: US 6,915,729 B2
(45) Date of Patent: Jul. 12, 2005

(54) VARIABLE FLOW CONTROL APPARATUS FOR ACTUATOR OF HEAVY CONSTRUCTION EQUIPMENT

(75) Inventor: Jin Wook Kim, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 36 days.

(21) Appl. No.: 10/716,069

(22) Filed: Nov. 18, 2003

(65) Prior Publication Data

US 2004/0237772 A1 Dec. 2, 2004

(30) Foreign Application Priority Data

May 28, 2003 (KR) ..... 10-2003-0034114

(51) Int. Cl.[7] ..... F15B 13/04
(52) U.S. Cl. ..... 91/445; 91/446; 137/596.13
(58) Field of Search ..... 91/445, 446, 447; 137/596.13

(56) References Cited

FOREIGN PATENT DOCUMENTS

| | | |
|---|---|---|
| GB | 2315521 | 2/1998 |
| GB | 2383382 | 6/2003 |
| JP | 7279906 | 10/1995 |
| JP | 7293510 | 11/1995 |

OTHER PUBLICATIONS

English Abstract of JP 7293510 Dated Nov. 7, 1995.
English Abstract of JP 7279906 Dated Oct. 27, 1995.

*Primary Examiner*—Edward K. Look
*Assistant Examiner*—Michael Leslie
(74) *Attorney, Agent, or Firm*—Ladas & Parry LLP

(57) ABSTRACT

The present invention relates to a variable flow control apparatus for an actuator of a heavy construction equipment capable of implementing constant flow of hydraulic fluid from a hydraulic pump to an actuator even when a pilot pressure capable of driving a seat valve openably and closably installed in a discharge flow path of the hydraulic pump exceeds a certain pressure level.

3 Claims, 4 Drawing Sheets

VARIABLE FLOW CONTROL APPARATUS FOR ACTUATOR OF HEAVY CONSTRUCTION EQUIPMENT

BACKGROUND OF THE INVENTION

1. Field of the Invention

The present invention relates to a variable flow control apparatus for an actuator of a heavy construction equipment, and in particular to a variable flow control apparatus for an actuator of a heavy construction equipment that is capable of implementing an efficient operation of an actuator by allowing the hydraulic fluid to flow from a hydraulic pump to an actuator by a constant flow even when the flow control signal pressure applied to a seat valve openably and closably installed in a discharge flow path of a hydraulic pump exceeds a certain pressure level.

2. Description of the Background Art

As shown in FIG. 1, conventional flow control apparatus for an actuator of heavy construction equipment includes a directional control valve 100, a seat valve assembly 500 and a pilot flow control valve 2.

The directional control valve 100 controls a start, stop and direction change of a hydraulic actuator (such as a boom cylinder, etc.) according to the switching operation of a spool 3 when pilot pressure is applied.

The seat valve assembly 500, which is openably and closably installed in downstream flow paths 7A, 7B and the flow path 7C, limits the flow of hydraulic fluid supplied to a pair of main variable throttles 16A and 16B from the hydraulic pump through the flow paths 7A, 7B and 7C and additionally limits the flow of a pair of load paths 6A and 6B.

The pilot flow control valve 2 controls the movement of the seat valve assembly 500 according to the switching operation of a pilot spool 41 when pilot pressure Pi is supplied.

The seat valve assembly 500, which is operated by the pressure difference between a pair of the load paths 6A and 6B and the flow path 7C, includes a first seat valve 501 and a second seat valve 502. The first seat valve 501, which moves in a housing 1, includes a variable throttle 512 for pilot pressure control adapted to vary an opening area with its movement. And the second seat valve 502, which moves relative to the first seat valve 501, has a variable throttle 511 adapted to vary an opening area of the flow path 7C of the hydraulic pump to the flow paths 7A and 7B with its movement.

In the second seat valve 502, the flow path 7C is connected with the flow paths 7A and 7B through the variable throttle 511. The path communicating with the variable throttle 512 is connected with a pilot path 521 of the pilot flow control valve 2. Here, the pilot path 521 is disconnected with a pilot path 522 of the hydraulic pump by the pilot spool 41 that is in the neutral state.

In the drawings, reference numeral 1 represents a housing in which a spool 3 is switched, and a seat valve assembly 500 is installed. The reference numeral 525 represents a variable throttle that is formed in an outer portion of the pilot spool 41 and is varied with the movement of the pilot spool 41. Reference character C represents a spool cap, which is installed one end of the directional control valve 100 and has an elastic member D adapted to elastically force an initial stage in which the hydraulic fluid from the pump path to the load paths 6A and 6B is blocked.

Therefore, in the case that the pilot pressure Pi is not applied to the pilot flow control valve 2, the second seat valve 502 is naturally moved by the pressure difference between the load paths 6A and 6B and the flow path 7C of the hydraulic pump, so that it is possible to disconnect the flow path 7C from the flow paths 7A and 7B without time delay even when the pressure in the load paths 6A and 6B is higher than the pressure of the hydraulic pump, for thereby preventing a dangerous problem that the actuator is not controlled.

In the case that the flow of hydraulic fluid supplied to the actuator should be limited in order to drive a hydraulic motor (not shown) or an actuator with a big load, the pilot spool 41 is switched in the left direction as shown in FIG. 1 in proportion to the pilot pressure Pi applied to the pilot flow control valve 2. With this, the blocked pilot paths 522 and 521 are opened through the variable throttle 525 of the pilot spool 41, and the pressure of the hydraulic fluid of the hydraulic pump passes through the pilot paths 522 and 521 and is applied to a pressure chamber 524 of the first seat valve 501.

Here, since the first seat valve 501 is moved in the downward direction as shown in FIG. 1 so that the opening area of the variable throttle 525 of the pilot spool 41 may be varied in proportion to the opening area of the pilot pressure control variable throttle 512, the second seat valve 502 is limited to move in the upward direction.

With the movement of the second seat valve 502 being limited, the flow of hydraulic fluid from the flow path 7C to the flow paths 7A and 7B of the hydraulic pump can be controlled.

However, in the conventional flow control apparatus, if the pilot pressure Pi applied to the pilot flow control valve 2 exceeds a certain pressure, the first seat valve 501 is moved in the maximum downward direction as shown in FIG. 1, so that the second seat valve 502 is closed.

Therefore, while the hydraulic priority of operations can be implemented by limiting the flow of hydraulic fluid from the flow path 7C to the flow paths 7A and 7B of the hydraulic pump, a pressure loss may occur due to a throttling in the hydraulic fluid paths in the case that the pressure exceeds a certain pressure level during the combined operations.

SUMMARY OF THE INVENTION

Accordingly, it is an object of the present invention to provide a variable flow control apparatus for an actuator of a heavy construction equipment that is capable of reducing the pressure loss even in the case that pilot pressure over a certain level causes the throttle in a seat valve by opening the seat valve when the load of actuator is over a certain pressure.

To achieve the above objects, a variable flow control apparatus for an actuator of a heavy construction equipment is comprised of an actuator connected to a hydraulic pump, a directional control valve that is disposed between the hydraulic pump and the actuator and is adapted to control a start, stop and direction change of the actuator when a spool installed in a housing is switched, a first seat valve that is movably installed in the housing and has a variable throttle varying according to its movement, a second seat valve that is openably and closably installed between a pump path of the hydraulic pump and a upstream/downstream flow paths and has a variable throttle adapted to change opening area from the pump path to the flow paths when being moved relative to the first seat valve, a pilot flow control valve that has a pilot spool switchable by pilot pressure and is adapted to control the movement of the first and second seat valves, a third seat valve that is installed elastically and movably relative to the second seat valve and switched to direct constant flow from the hydraulic pump path to the downstream flow paths when pilot pressure over a certain level is applied to the pilot flow control valve and a sub-piston that is slidably installed in the interior of the pilot spool and expands opening area of the downstream flow paths of the hydraulic pump, which is in a throttling state, by switching the second seat valve in the upward direction when pressure of the downstream flow paths exceeds a certain pressure level.

In addition, the sub-piston is pressurized by pilot pressure from a pilot flow path, which is comprised of a first pilot flow path formed in the housing in such a manner that its entrance communicates with the downstream flow paths, a second pilot flow path formed in the pilot flow control valve in such a manner that its entrance communicates with an outlet of the first pilot flow path, a third pilot flow path formed in the pilot flow control valve in such a manner that its entrance communicates with an outlet of the second pilot flow path and an orifice communicating with an engaging groove, which is formed in the pilot spool and engaged with the sub-piston, and communicating with an outlet of the third pilot flow path.

The third seat valve is slidably installed and elastically supported in the interior of the second seat valve in such a manner that an initial state is held in which the downstream flow paths and the upstream flow path are disconnected with each other.

BRIEF DESCRIPTION OF THE DRAWINGS

The present invention will become better understood with reference to the accompanying drawings which are given only byway of illustration and thus are not limitative of the present invention, wherein.

DETAILED DESCRIPTION OF THE PREFERRED EMBODIMENTS

Figure 1:
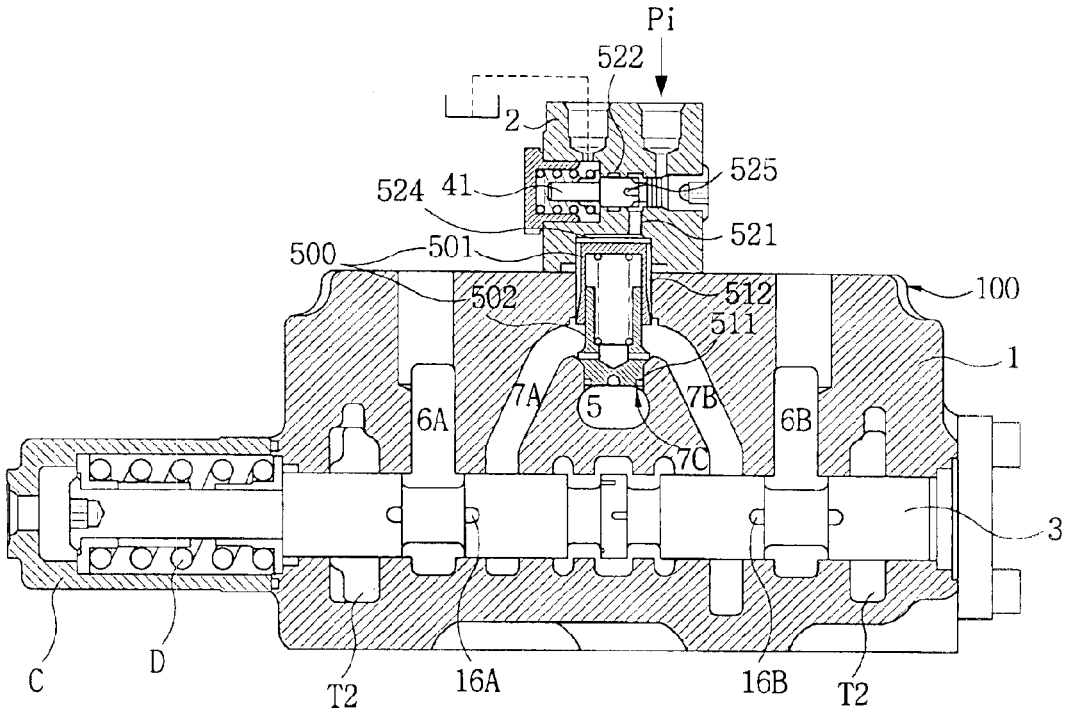
FIG. 1 is a cross sectional view illustrating a conventional flow control apparatus.
Figure 2:
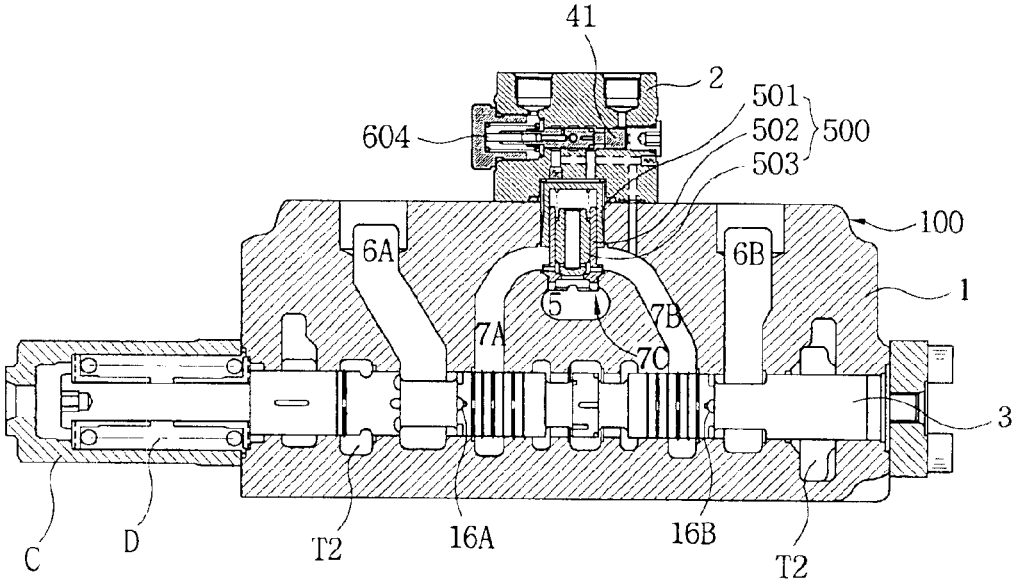
FIG. 2 is a cross sectional view illustrating a variable flow control apparatus for an actuator of heavy construction equipment according to the present invention.
Figure 3:
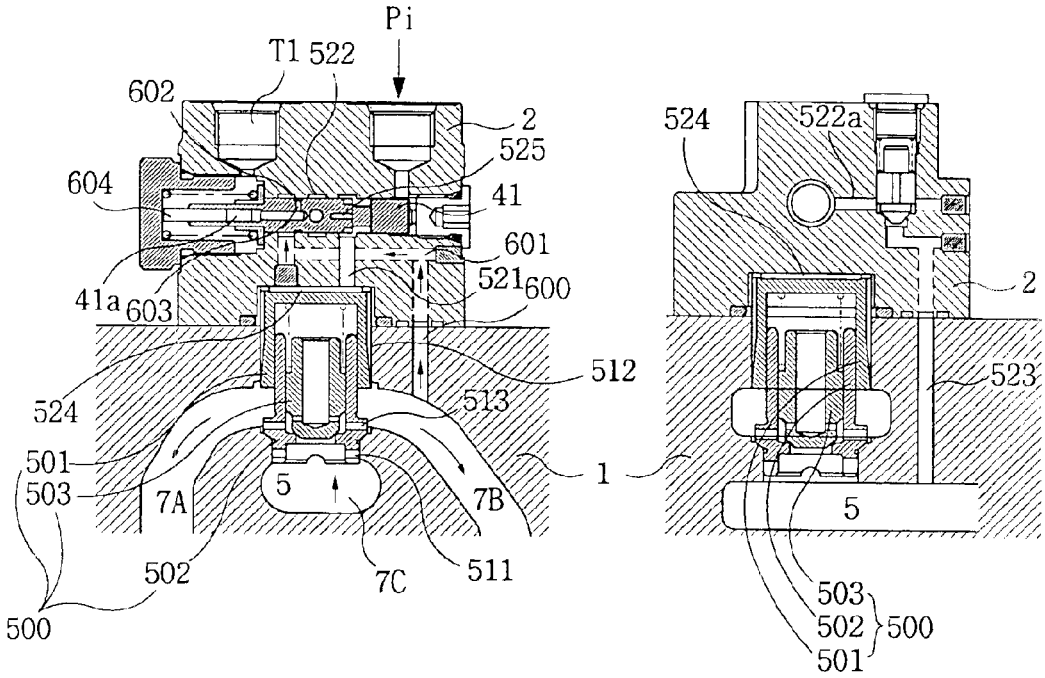
FIG. 3 is an enlarged view illustrating the seat valve of FIG. 2 according to the present invention.
Figure 4:
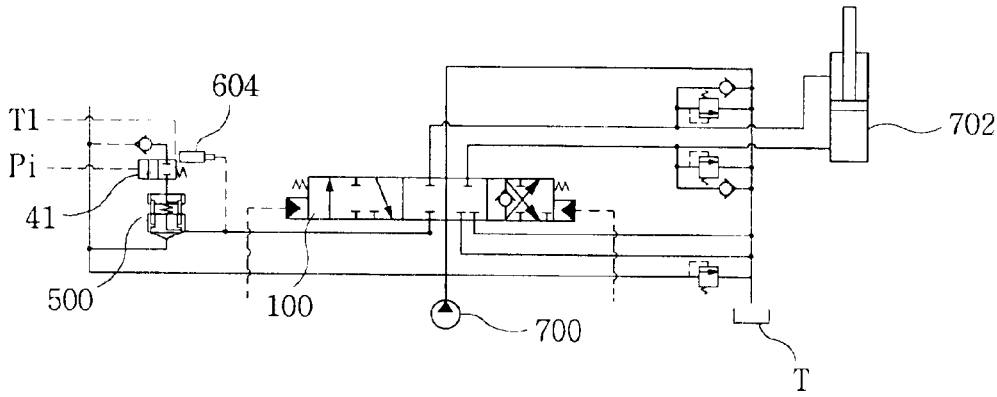
FIG. 4 is a view illustrating a hydraulic circuit of a variable flow control apparatus for an actuator of heavy construction equipment according to the present invention.

As shown in FIGS. 2 through 4, a variable flow control apparatus for an actuator of a heavy construction equipment according to the present invention includes a hydraulic pump 700, an actuator 702 connected to the hydraulic pump 700, a directional control valve 100 that is disposed between the hydraulic pump 700 and the actuator 702, a first seat valve 501, a second seat valve 502, a pilot flow control valve 2, a third seat valve 503, and a sub-piston 604.

The directional control valve 100 has a housing 1 and a spool 3, which is installed in the housing 1, and controls a start, stop and direction change of the actuator 702 when the spool 3 is switched.

The first seat valve 501 is movably installed in the housing 1 of the directional control valve 100 and has a variable throttle 512. The second seat valve 502 is openably and closably installed between a pump path 5 of the hydraulic pump 700 and flow paths 7A, 7B, 7C and has a variable throttle 511. The flow paths 7A, 7B are downstream flow paths, and the flow path 7C is an upstream flow path.

As the first seat valve 501 moves relative to the housing 1, the variable throttle 512 varies the opening area of the flow paths 7A, 7B to a pilot path 521. And as the second seat valve 502 moves relative to the first seat valve 501, the variable throttle 511 varies the opening area of the pump path 5 to the flow paths 7A, 7B.

The pilot flow control valve 2 has a pilot spool 41 switchable by pilot pressure and controls the movement of the first and second seat valves 501, 502. The third seat valve 503 is installed elastically and movably relative to the second seat valve 502 and switched to direct constant flow from the pump path 5 to the flow paths 7A, 7B when pilot pressure over a certain level is applied to the pilot flow control valve 2.

The sub-piston 604 is slidably installed in the interior of the pilot spool 41 and expands the opening area of the flow paths 7A, 7B, which are in a throttling state, by switching the second seat valve 502 in the upward direction when the pressure of the flow paths 7A, 7B exceeds a certain pressure level.

Here, the sub-piston 604 is pressurized by pilot pressure from a pilot flow path comprising a first pilot flow path 600, a second pilot flow path 601, a third pilot flow path 602, and an orifice 603.

The first pilot flow path 600 is formed in the housing 1 in such a manner that its entrance communicates with the downstream flow paths 7A, 7B. And the second pilot flow path 601 is formed in the pilot flow control valve 2 in such a manner that its entrance communicates with an outlet of the first pilot flow path 600.

The third pilot flow path 602 is formed in the pilot flow control valve 2 in such a manner that its entrance communicates with an outlet of the second pilot flow path 601. And the orifice 603 communicates with an engaging groove 41*a*, which is formed in the pilot spool 41 and engaged with the sub-piston 604, and communicates with an outlet of the third pilot flow path 602.

In the drawings, reference characters T1 and T2 represent the paths connected to the hydraulic tank.

The operation of the variable control apparatus for an actuator of heavy construction equipment according to the present invention will be described with reference to the accompanying drawings.

a) The operation when pilot pressure Pi is not supplied to the pilot flow control valve 2 will be described.

As shown in FIGS. 2 through 4, the second seat valve 502 and the third seat valve 503 are naturally moved by the pressure difference between the load paths 6A and 6B and the flow path 7C of the hydraulic pump 700. Even in the case that the pressure of the load paths 6A and 6B is higher than the pressure of the hydraulic pump 700, it is possible to disconnect the flow path 7C from the flow paths 7A and 7B without time delay for thereby preventing a dangerous problem that the actuator 702 is not controlled.

In the case that the flow of hydraulic fluid supplied to the actuator 702 should be limited in order to drive a hydraulic motor or another actuator with a big load, the pilot spool 41 is switched in the left direction as shown in FIG. 3 in proportion to the pilot pressure Pi applied to the pilot flow control valve 2.

Therefore, the blocked pilot paths 522, 521 are opened through the variable throttle 525 of the pilot spool 41, and the pressure of the hydraulic fluid of the hydraulic pump passing through the pilot paths 523, 522*a*, 522, 521 is applied to a pressure chamber 524 of the first seat valve 501.

Here, since the first seat valve 501 is moved in the downward direction as shown in FIG. 3 so that the opening area of the variable throttle 525 of the pilot spool 41 may be varied in proportion to the opening area of the variable throttle 512, the second seat valve 502 is limited to move in the upward direction.

With the movement of the second seat valve 502 being limited, the flow of hydraulic fluid from the flow path 7C to the flow paths 7A and 7B of the hydraulic pump can be controlled.

b) The operation that pilot pressure Pi over a certain pressure level is applied to the pilot flow control valve 2 will be described.

Since the pilot spool 41 is switched in the left direction when the pilot pressure Pi is applied to the pilot flow control valve 2 as shown in FIG. 3, the pilot flow paths 522 and 521 are opened by the variable throttle 525, so that the pressure of the hydraulic fluid of the hydraulic pump 700 is applied to the pressure chamber 524 of the first seat valve 501.

The first seat valve 501 is moved in the maximum downward direction as shown in FIG. 3. The flow of hydraulic fluid passing through the variable throttle 511 is blocked as the second seat valve 502 is closed moving along the first seat valve 501.

The third seat valve 503 is moved in the upward direction as shown in FIG. 3, so that constant flow of hydraulic fluid can be supplied from the pump path 5 of the hydraulic pump 700 to the flow paths 7A and 7B passing a through hole 513 formed in a lower side of the second seat valve 502.

The hydraulic fluid of the flow path 7B operates as an intermediate pressure of the pump path 5 and the load paths 6A and 6B of the hydraulic pump 700 and passes through the first, second and third pilot flow paths 600, 601, 602 and the orifice 603 sequentially in the direction indicated by the arrow in FIG. 3.

When the sub-piston 604, which is installed in the pilot spool 41, is pressed in the left direction, the pilot spool 41 is moved in the right direction as shown in FIG. 3 according to the repulsive force of the sub-piston 604. The flow supplied to the pressure chamber 524 of the first seat valve 501 through the variable throttle 525 of the pilot spool 41 is limited Therefore, the first seat valve 501 is not fully pushed in the downward direction as shown in FIG. 3. The second seat valve 502 is slowly moved in the upward direction in proportion to the movement of the first seat valve 501. With the above state, since the opening area of the flow paths 7A and 7B to the flow path 7C is gradually increased, the pressure loss is minimized, while reducing the resistance of the paths, so that it is possible to save the hydraulic energy.

As described above, the variable flow control apparatus for an actuator of heavy construction equipment according to the present invention has the following advantages.

In the case that the pressure of the hydraulic fluid in the side of the hydraulic pump exceeds a certain pressure level, the opening area of paths of the seat valve used to limit the hydraulic fluid supplied to the actuator is expanded, so that the pressure loss is minimized in the paths, which is in a throttling state, for thereby saving the hydraulic energy.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A variable flow control apparatus for an actuator of a heavy construction equipment, comprising:

an actuator connected to a hydraulic pump;

a directional control valve that is disposed between the hydraulic pump and the actuator and is adapted to control a start, stop and direction change of the actuator when a spool installed in a housing is switched;

a first seat valve that is movably installed in the housing and has a variable throttle varying according to its movement;

a second seat valve that is openably and closably installed between a pump path of the hydraulic pump and a upstream/downstream flow paths and has a variable throttle adapted to change opening area from the pump path to the flow paths when being moved relative to the first seat valve;

a pilot flow control valve that has a pilot spool switchable by pilot pressure and is adapted to control the movement of the first and second seat valves;

a third seat valve that is installed elastically and movably relative to the second seat valve and switched to direct constant flow from the hydraulic pump path to the downstream flow paths when pilot pressure over a certain level is applied to the pilot flow control valve; and a sub-piston that is slidably installed in the interior of the pilot spool and expands opening area of the downstream flow paths of the hydraulic pump, which is in a throttling state, by switching the second seat valve in the upward direction when pressure of the downstream flow paths exceeds a certain pressure level.

2. The apparatus of claim 1, wherein said sub-piston is pressurized by pilot pressure from a pilot flow path, which comprises:

A first pilot flow path formed in the housing in such a manner that its entrance communicates with the downstream flow paths;

a second pilot flow path formed in the pilot flow control valve in such a manner that its entrance communicates with an outlet of the first pilot flow path;

a third pilot flow path formed in the pilot flow control valve in such a manner that its entrance communicates with an outlet of the second pilot flow path; and an orifice communicating with an engaging groove, which is formed in the pilot spool and engaged with the sub-piston, and communicating with an outlet of the third pilot flow path.

3. The apparatus of claim 1, wherein said third seat valve is slidably installed and elastically supported in the interior of the second seat valve in such a manner that an initial state is held in which the downstream flow paths and the upstream flow path are disconnected with each other.

* * * * *